United States Patent [19]

Kikuchi et al.

[11] Patent Number: 5,002,414

[45] Date of Patent: Mar. 26, 1991

[54] METHOD OF AUTOMATICALLY INSERTING PRINTING PAPER IN AN AUTOMATIC PAPER FEEDER

[75] Inventors: Hiroshi Kikuchi; Jiro Tanuma; Tadao Shimizu; Akira Nagumo; Shinichi Katakura, all of Tokyo, Japan

[73] Assignee: Oki Electric Industrial Co., Ltd., Tokyo, Japan

[21] Appl. No.: 863,254

[22] Filed: May 14, 1986

[30] Foreign Application Priority Data

May 15, 1985 [JP] Japan ..... 60-101456

[51] Int. Cl.[5] ..... B41J 13/00

[52] U.S. Cl. ..... 400/625

[58] Field of Search ..... 400/624, 625, 629

[56] References Cited

U.S. PATENT DOCUMENTS

| | | | |
|---|---|---|---|
| 3,963,110 | 6/1976 | Hyland et al. | 400/629 |
| 4,275,969 | 6/1981 | Matsuhisa et al. | 400/629 |
| 4,362,409 | 12/1982 | Endo | 400/625 |
| 4,396,307 | 8/1983 | Shah et al. | 400/625 |
| 4,407,597 | 10/1983 | Kapp | 400/625 |
| 4,469,454 | 9/1984 | Crean | 400/625 |
| 4,569,611 | 2/1986 | Watanabe et al. | 400/624 |
| 4,583,872 | 4/1986 | Chu et al. | 400/625 |

*Primary Examiner*—Clifford D. Crowder

*Attorney, Agent, or Firm*—Wenderoth, Lind & Ponack

[57] ABSTRACT

A method of automatically inserting a printing paper in a hopper of an automatic paper feeder or a manual insertion printing paper inserted from a manual paper input slot. Upon receiving an instruction to insert a printing paper by a printer, a platen is first rotated. Thereupon, provided the presence of the printing paper is detected by a sensor even with the platen being rotated by a prescribed amount, a paper feed motor of the automatic paper feeder is rotated for obtaining a printing paper from the hopper. While, provided the presence of a printing paper is detected before the platen is rotated by the prescribed amount, the paper feed motor is not rotated, it being assumed that the manual insertion of a printing paper has been already performed. After detected the presence of the printing paper, the platen is rotated by a prescribed amount to cause the printing paper to be moved to a position where a first line of the printing paper faces the face of the printing head.

2 Claims, 5 Drawing Sheets

METHOD OF AUTOMATICALLY INSERTING PRINTING PAPER IN AN AUTOMATIC PAPER FEEDER

BACKGROUND OF THE INVENTION

1. Field of the invention

The present invention relates to a method of automatically inserting a printing paper in an automatic paper feeder mounted on a printer for automatically feeding the printing paper.

2. Description of the Prior Art

An automatic paper feeder of this type is disclosed for example in U.S. Pat. No. 4,529,189. The automatic paper feeder consists of a hopper for taking a cut sheet among a plurality of cut sheets accumulated on a sheet guide, a paper feed guide for guiding the cut sheet so taken out to a platen of a printer, and a stacker for discharging and accumulating cut sheets each having character data printed thereon by a printer.

The operation of feeding a paper sheet in the automatic paper feeder described above is as follows.

Paper sheets are first taken out one at a time based on a signal to instruct the paper sheet to be inserted. The cut sheet so taken out is forced to pass through the paper feed guide and wound around the platen forwardly from the rear lower portion thereof. In addition, the cut sheet is, after subjected to printing by a printing head of the printer, fed from the front upper part of the platen to the stacker.

Furthermore, U.S. Pat. No. 4,326,815 is also known wherein an automatic paper feeder of the type described above consists of a printing paper tray, a drive roller for taking out a printing paper from the tray, a paper feed path, two sensors provided on the paper feed path and a hopper composed of a deflector plate and an exit guide plate.

The paper feeder described above effcts the following operations of feeding a printing paper. According to the first operation, the drive roller is first rotated to take out the printing paper from the paper tray. The paper so taken out is guided to the paper feed path and conveyed toward the platen of the printer. After detecting the top end of the printing paper by the first sensor, the platen is rotated to furthermore convey the paper until the top end thereof is detected by the second sensor to permit the printing paper to be stopped. Thereafter, character data is printed on the printing paper by the printing head. After the printing is finished, the paper printed as described above is conveyed to the hopper.

According to the second operation, with an upper tray switch and a lower tray switch being depressed, the printing head is positioned at the center of the printer, and the automatic paper feeder is placed in an envelope/single sheet mode. An envelope or single sheet is inserted into an input slot formed between a deflector plate and an exit guide plate. Thereafter, turning a platen knob, the printing paper is set to a prescribed position.

SUMMARY OF THE INVENTION

It is an object of the present invention to provide an improved method to automatically insert a printing paper in an automatic paper feeder capable of feeding not only printing paper taken out from a paper housing stacker but also paper inserted manually into a printer.

According to the present invention, after instructing the printer to insert a printing paper, the platen is first rotated. When the presence of the printing paper is not detected even with the platen being rotated by a prescribed amount, a paper feed motor is rotated to permit the printing paper to be taken out of the hopper. While, the presence of the printing paper is detected, the paper feed motor is not rotated and a printing paper is inserted manually. After detected a printing paper, the platen is rotated by a prescribed amount to permit the printing paper to be moved to a position where a first line of the printing paper is located facing the face of the printing head.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
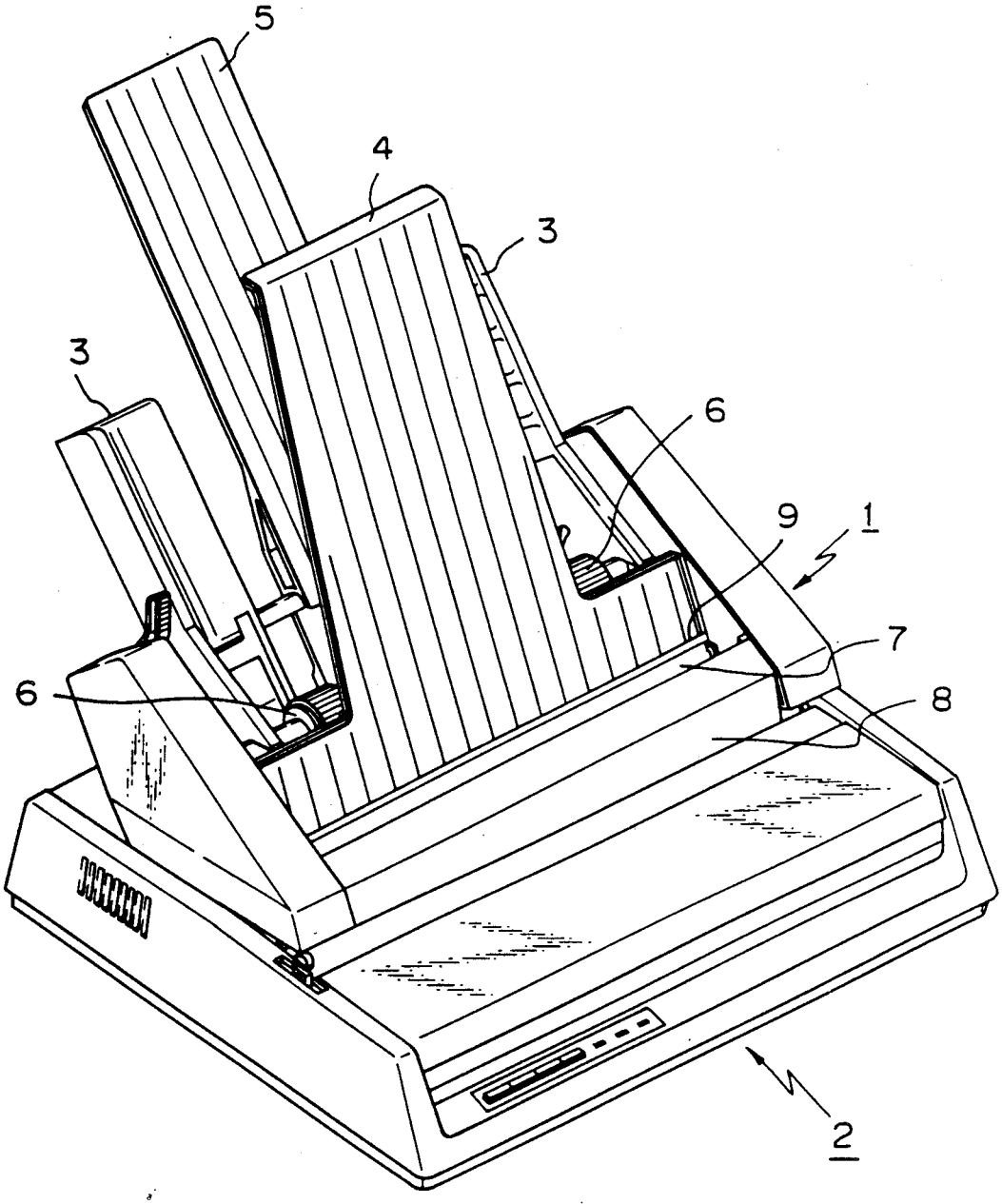
FIG. 1 is a perspective view of a printer having an automatic paper feeder mounted thereon.

In FIG. 1 illustrating an automatic paper feeder mounted on a printer, element 1 is an automatic paper feeder and 2 is a printer. As shown in the figure, the automatic paper feeder 1 has a hopper 3, a front sheet support 4, a rear sheet support 5, a roller 6, a housing bracket 7, and a guide plate 8. Printing papers are separated one by one away from a paper housing surrounded by the rear sheet support 5 and the hopper 3 by means of the roller 6, and conveyed to the platen. A printing paper to be printed upon is guided by the guide plate 8 and conveyed to the paper housing surrounded by the front sheet support 4 and the housing bracket 7. A printing paper is insertable from an input slot 9 disposed between the front sheet support 4 and the housing bracket 7. This insertion will be referred to as a manual insertion hereinafter, and the printing paper inserted manually as a manually inserted printing paper.

Described below is the route used to convey a printing paper with reference to FIGS. 2 and 3. Now, in the same figure illustrating the route used to convey the printing paper 17, element 10 is a printing head, 11 is a platen, 12 is a printing paper fed to the printing paper housing surrounded by the rear sheet support 5 and the hopper 3, 13 is a paper guide for guiding the printing paper 12 or the manually inserted printing paper 17 along the platen 11, 14*a* and 14*b* are press rollers in contact with the platen 11 for feeding the printing paper 12 or manually inserted printing paper 17, 15*a* and 15*b* are respectively a discharge roller for feeding a printing paper having been already subjected to printing to the paper housing surrounded by the front sheet support 4 and the housing bracket 7, 16 is a sensor for detecting the presence of the printing paper 12 or the manually inserted printing paper 17.

Figure 2:
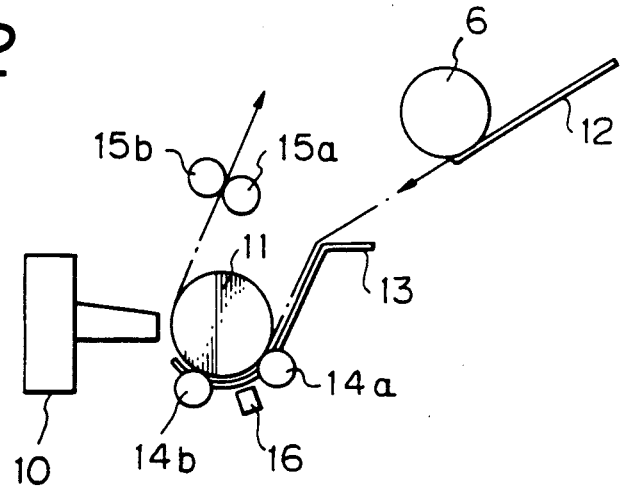
FIG. 2 is a view illustrating a route of conveying a printing paper 12 and a direction of conveying the paper.

Referring to FIG. 2 illustrating the route used to convey the printing paper 12 in the paper housing surrounded by the rear sheet support 5 and the hopper 3, the printing paper is conveyed in a direction shown in the figure along a route shown by a one-dot line. In more detail, the printing paper 12 separated one by one by means of the roller 6 is conveyed while being guided by the paper guide. The printing paper is, after being conveyed to a contact part between the platen 11 and the press roller 14, conveyed by rotating force of the platen 11 along the peripheral surface of the platen 11. The printing paper, after being subjected to printing by the printing head 10, is discharged by the discharge rollers 15*a*, 15*b*.

Figure 3:
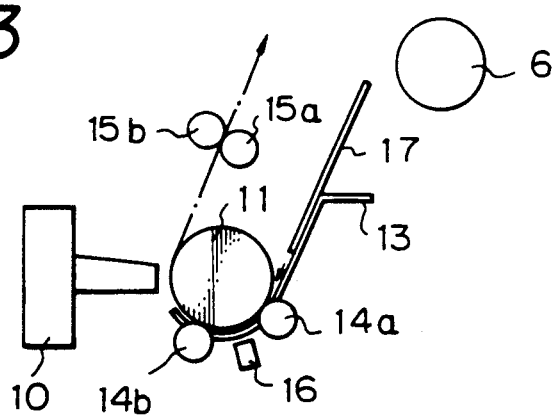
FIG. 3 is a view illustrating a route of conveying a manually inserted printing paper 17 and a direction of conveying the paper.

Then, referring to FIG. 3 illustrating the route used to convey the manually inserted paper 17, the manually inserted printing paper 17 is conveyed to a direction of an arrow shown in the figure along a route shown by a one-dot line. Describing this in more detail, the manually inserted printing paper inserted from the input slot 9 of FIG. 1 is inserted to the contact part between the platen 11 and the roller 14*a*. A route used to convey the printing paper thereafter is the same as that shown in FIG. 2.

Figure 4:
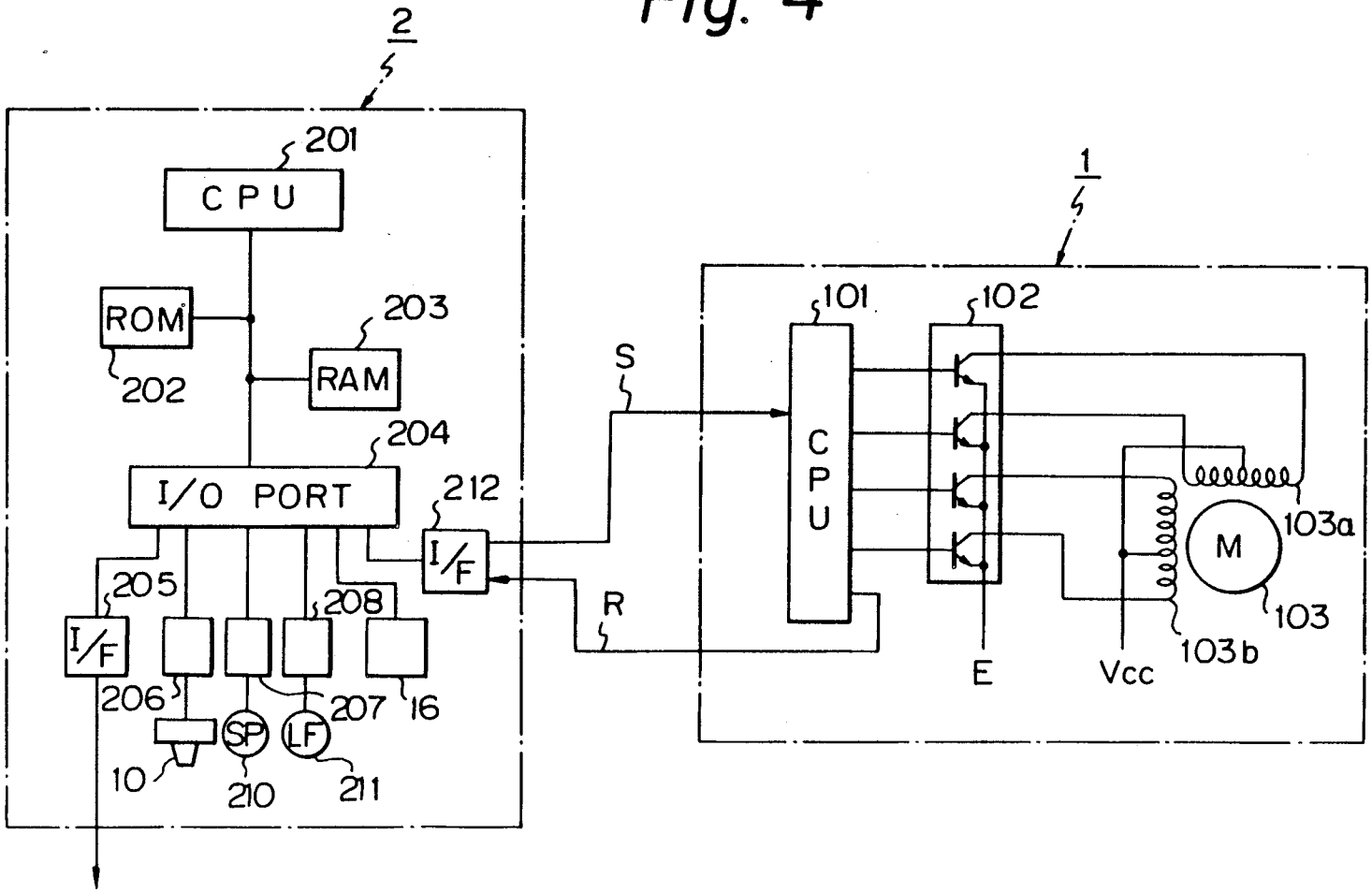
FIG. 4 is a schematical block diagram illustrating an automatic paper feeder 1 and a printer 2.

Described below is a method to automatically insert printing paper according to the present invention with reference to FIGS. 4, 5, and 6. Referring to FIG. 4 illustrating a control circuit for controlling the paper feed, element 1 is an automatic paper feeder, 2 is a printer, 101 is a CPU, 102 is a driver circuit, 103 is a paper feed motor, 103*a*, 103*b* are respectively a coil of the paper feed motor, 201 is a CPU, 202 is a ROM for storing a program of the CPU 201, 203 is a RAM for temporarily storing data transmitted from a upstream apparatus, 204 is an I/O port, 205, is an interface with the upstream apparatus, 206 is a printing head drive circut, 207 is a spacing motor (SP motor) drive circuit, 208 is a line feed motor (LF motor) drive circuit, 210 is a SP motor for spacing the printing head 10, 211 is a LF motor for rotating the platen 11, and 212 is an interface with the automatic paper feeder 1. As shown in the figure, the printer 2 and the automatic paper feeder 1 are mutually connected via a sending line S and receiving line R. The CPU 101 of the automatic paper feeder 1 issues a signal to switch a transistor of the driver circuit 102 on and off for driving and stopping the paper feed motor 103. In addition, the CPU 101 informs the printer 2 side via the line R of the states of the automatic paper feeder 1, e.g., the states of "paper end", "the automatic papter feeder 1 is connected" and the like. Here, the arrangement in a block showing the driver circuit 102 is drawn in a simplified form. Namely, the driver circuit 102 may be controlled such that a current from Vcc to E is forced to flow through the coil of the paper feed motor by an "ON" signal from the CPU 101. With the driver circuit 102 so controlled to its on/off operation, rotation of the paper feed motor 103 is controlled.

Figure 5:
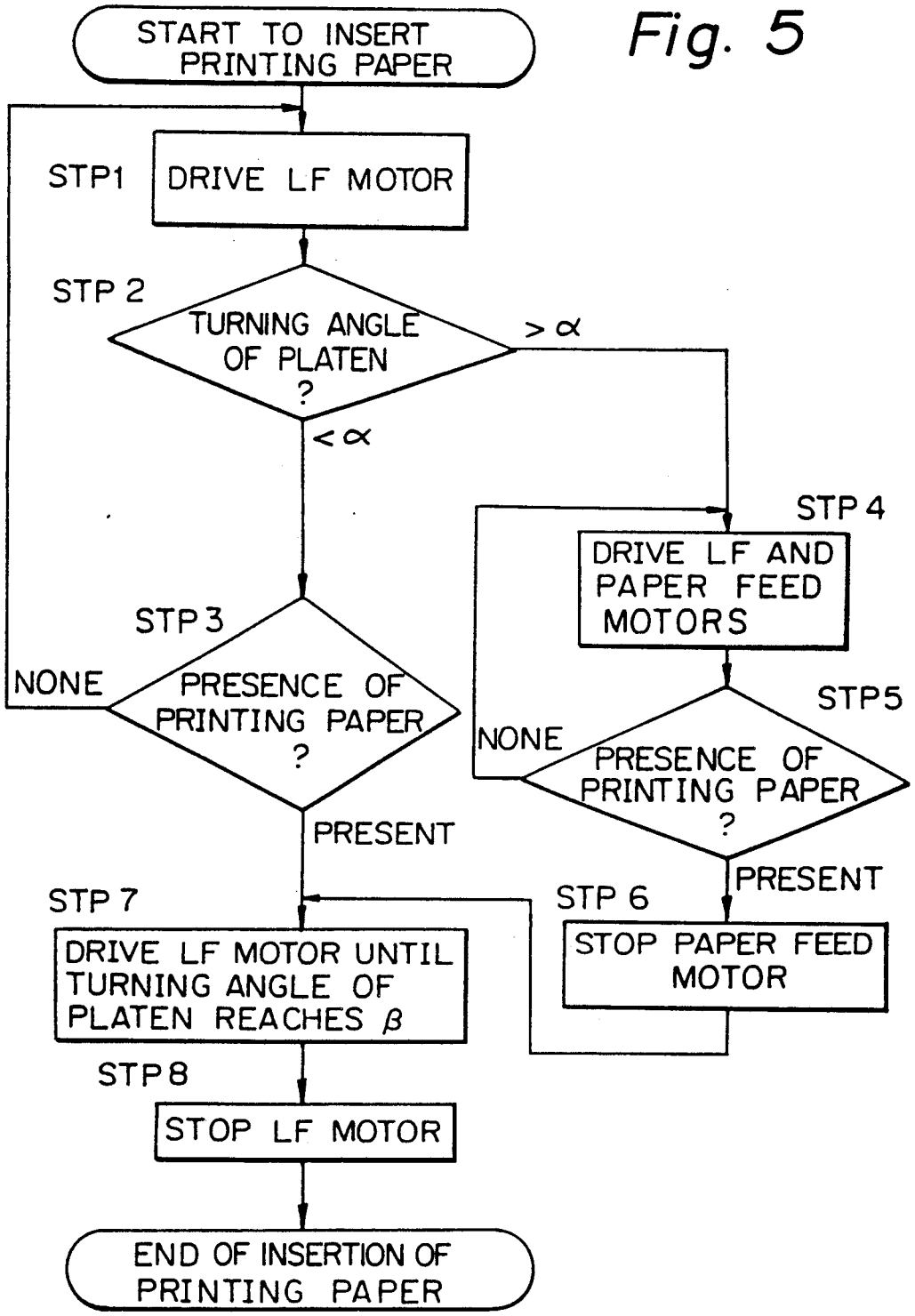
FIG. 5 is a flowchart illustrating a procedure to insert a printing paper by a printer 2.
Figure 6:
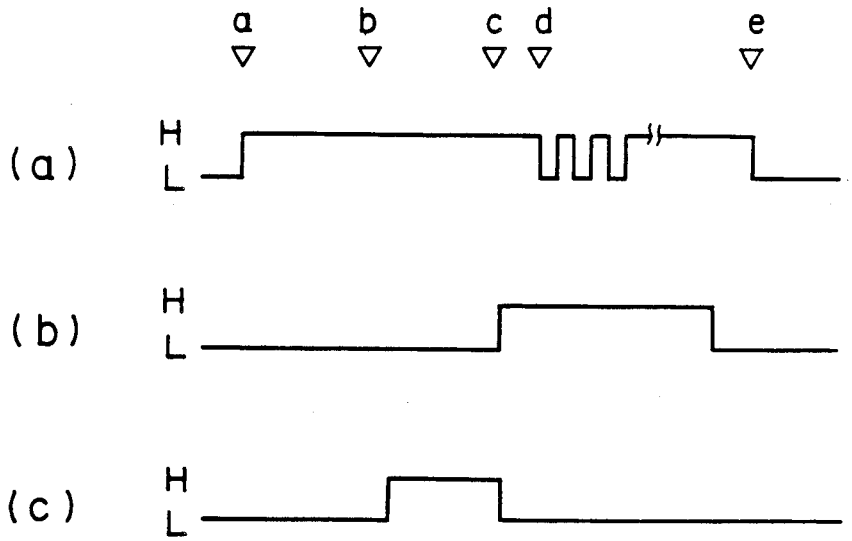
FIG. 6 is a timing chart illustrating procedures to insert the printing paper 12 and to print character data on the paper and FIG. 7 is a timing chart illustrating procedures to manually insert printing paper 17 and print data on the paper.
Figure 7:
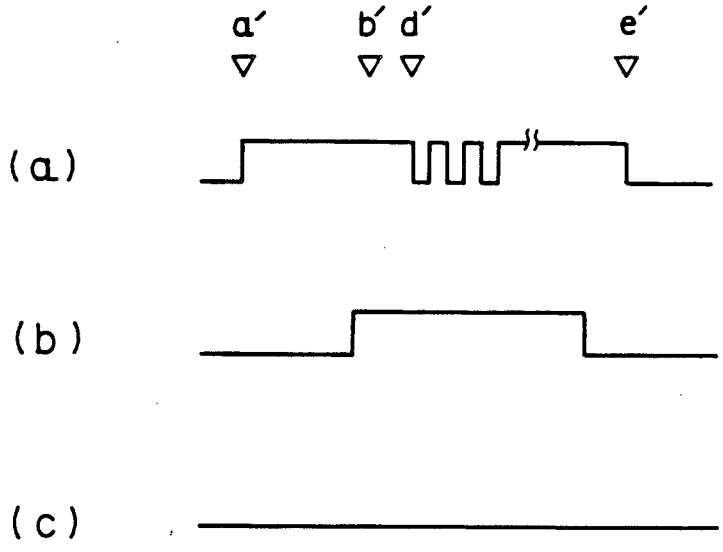

Described below in detail are procedures of the automatic paper feeder according to the present invention to insert a printing paper, print character data on it and discharge it, with reference to FIG. 5 showing a flowchart indicative of the procedure to insert a printing paper, and FIGS. 6 and 7 showing a timing chart of the procedure of printing and inserting a printing paper.

(1) Procedure to insert a printing paper.

Figure 8:
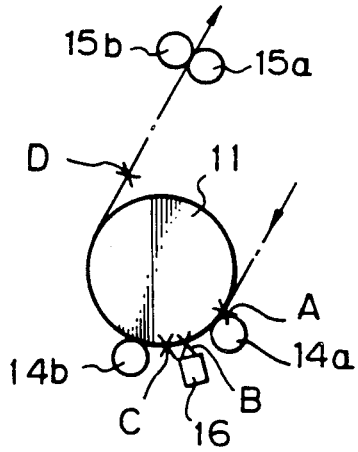
FIG. 8 is a view illustrating check points in the route to convey a printing paper.

This procedure to insert a printing paper to point D of FIG. 8 and force a first printing line of the paper to face to the printing paper head 10. In this case, a manually inserted printing paper 17 and an automatically inserted paper 12 are processed differently.

(A) Procedure to insert a printing paper 12.

The CPU 201 receives an instruction from the upstream apparatus via the interface 205 and the I/C port 204 to insert a printing paper, and the CPU 201 starts to insert a printing paper in accordance with a program stored in the ROM 202.

The CPU 201 first instructs the LF motor drive circuit 208 to rotate the LF motor 211 via the I/O port, 204 (STP 1 of FIG. 1). Then, the CPU 201 judges whether the turning angle of the platen reaches $\alpha$ (STP 2). This may be done by storing the number of drive pulses needed to rotate the paper feed motor by the turning angle $\alpha$ above in a register (not shown) or the RAM 203 of the CPU 201, and comparing this value with the step number of pulses used for driving the LF motor 211 stored in a prescribed area of a register (not shown) of the CPU 201 or RAM 203. In this case, the value of the prescribed area of the RAM 203 or the register described above must be updated whenever the LF motor 211 is driven. As noted in the STP 2, if that the turning angle of the platen 11 does not reach $\alpha$, the CPU 201 advances to STP 3. In this step, the CPU 201 receives information from the sensor 16 (about the presence or absence of a printing paper) via the I/O port 204 for deciding the presence of any printing paper. Without any printing paper, the CPU 201 again returns to the STP 1. Keeping up in such a manner the rotation of the LF motor 211, the CPU 201 will soon advance from the STP 2 to STP 4. This occurs because the sensor 16 can not detect the presence of a printing paper even with the platen 11 rotated by $\alpha$ since no manually inserted paper 17 was inserted. If the manually inserted paper 17 has been inserted, as described later, the sensor 16 can detect the presence of a printing paper before platen 11 is rotated by $\alpha$ for permitting the CPU 201 to advance from the STP 3 to STP 7. In STP 4, the CPU 201 instructs, via the S line of FIG. 4, the CPU 101 of the automatic paper feeder 1 to drive the LF motor 211 as well as the paper feed motor 103 of the automatic paper feeder 1. The paper feed motor 103 is thus rotated. In STP 5, the presence of a printing paper is decided in the same manner as in the STP 3. After detecting the presence of a printing paper in the STP 5, the CPU 201 instructs, in STP 6, the CPU 101 to stop the paper feed motor. This is also done via the S line of FIG. 4. With the operation of the automatic paper feeder 1 described above, printing papers 12 are separated one by one from the paper housing surrounded by the rear sheet support 5 and the hopper 3 with the aid of the roller, and conveyed through the conveyance route shown in FIG. 2 to a position (position B of FIG. 8) where the top end of the printing paper 12 is detected by the sensor 16. In STP 7, the LF motor 211 is driven by a fraction of a revolution until the platen 11 is rotated by $\beta$ corresponding to an interval between B and D of FIG. 8.

After driving the LF motor 211 by $\beta$ as described above, it is stopped. In such a manner, the top end of the printing paper 12 is a moved to a point D until the printing head faces a first line of the printing paper 12. The process of inserting the printing paper is finished and its printing by the printing head 10 is made possible.

Referring here to FIG. 6 illustrating a timing chart of the processing to be described above such in a printing paper, waveform (a) shows a drive/stop signal (a) for the LF motor 211 by which the LF motor 211 is driven in a state "H" while stopped in a state "L". The drive/-stop signal is generated in the LF motor drive circuit 208 based on an instruction from the CPU 201. Waveform (b) shows an output signal from the sensor 16, and indicates that there is a printing paper in the state "H" and no printing paper in the state "L". Waveform (c) shows a drive/stop signal for the paper feed motor on the S line of FIG. 4, and indicates that the paper feed motor should be driven in the state "H" while stopped in the state "L". Characters (a) to (e) in the same figure show timing to drive the paper feed motor, and indicate that inserting printing paper is effected from the time instant (a) to the time instant (d) and discharge of the printing paper is effected from (d) to (e). The time instant (b) shows an instant when the platen 11 is rotated by $\alpha$, e.g., an instant when the control of the CPU 201 advances from the STP 2 to the STP 4. The time instant (c) shows an instant when the top end of the printing paper 12 is detected by the sensor 16, i.e., an instant when the CPU 201 advances from the STP 5 to the STP 6.

(B) Processing to insert the manually inserted printing paper 17.

The process to insert a manually inserted printing paper is started in the same manner as is the case of the printing paper 12. A difference between the present case and the case of (A) is only that the CPU 201 does not advance from the STP 2 to the STP 7 via the STP 4 to STP 6, but from the STP 2 to the STP 7 via the STP 3. The difference is due to the fact that since the manually inserted printing paper 17 has been inserted (the manually inserted printing paper 17 is brought into contact with the platen 11 and the press roller 14*a* at the point A in FIG. 8 and then has been stopped), the presence of the manually inserted printing paper 17 is detected by the sensor 16 in the middle of the platen 11 being rotated by $\alpha$.

Referring here to FIG. 7 illustrating a timing chart of the processing to insert a manual insertion printing paper, (a), (b), and (c) are provided to show the same signals as those in FIG. 6. The process to insert a manually inserted printing paper is effected from the time instant (a') to (d') in the same figure, while printing and discharge of a manually inserted printing paper are effected from the time instant (d') to (e'). The instant (b') shows an instant when the platen 11 is rotated by $\alpha$ which is where the presence of the manually inserted printing paper 17 is detected until it reaches the instant (b').

(2) Process to print character data on a printing paper and discharge it.

The processing is effected as usual. Namely, the automatic paper feeder 1 receives printing data (character code data or image data) sent from the upstream apparatus and prints it on a printing paper with the printing head 10. After printing one line on the printing paper, it forces the LF motor 211 to be rotated to cause the printing paper to be moved for printing on the next line. Thereafter, printing end line feeds are repeated. Thus, after the printing of one page of the printing paper is finished, the paper is discharged to the paper housing surrounded by the front sheet support 4 and the housing bracket 7.

Although a certain preferred embodiment has been shown and described, it should be understood that many changes and modifications may be made therein without departing from the scope of the appended claims.

What is claimed is:

1. In an automatic sheet feeding system having a press roller, a sheet sensor and a print head arranged in that order along a recording sheet conveying path, for inserting a sheet taken out from a hopper or manually inserted through a sheet inserting opening between a platen and said press roller so as to feed the sheet between said print head and said platen, a automatic recording sheet feeding method comprising the steps of:

rotating the platen;

determining whether or not the platen has been rotated by a first predetermined number of turns and whether or not any recording sheet has been inserted;

stopping the platen after rotating the platen by a second predetermined number of turns when the insertion of the recording sheet has been detected prior to the platen being rotated by the first predetermined number of turns; and delivering the recording sheet from the hopper and stopping the platen after rotating the platen by the second predetermined number of turns when the insertion of a recording sheet has not been detected prior to the platen being rotated by the first predetermined number of turns.

2. A recording sheet feeding method according to claim 1, wherein the recording sheet is moved a distance by the platen when the platen is rotated by the first predetermined number of turns which corresponds to the distance of travel of the recording sheet from the sheet inserting opening to a predetermined position beyond where the sheet sensor detects the insertion of the recording sheet.

* * * * *